US011169456B2

(12) United States Patent
Matsusaki et al.

(10) Patent No.: US 11,169,456 B2
(45) Date of Patent: Nov. 9, 2021

(54) ELECTROPHOTOGRAPHIC PHOTORECEPTOR

(71) Applicant: Konica Minolta, Inc., Tokyo (JP)

(72) Inventors: Mayuko Matsusaki, Hino (JP); Tomoko Sakimura, Hino (JP); Hiroki Takao, Hachioji (JP); Kengo Ikeda, Kitamoto (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/849,461

(22) Filed: Apr. 15, 2020

(65) Prior Publication Data

US 2020/0363740 A1 Nov. 19, 2020

(30) Foreign Application Priority Data

May 16, 2019 (JP) ..... JP2019-093140

(51) Int. Cl.
*G03G 5/00* (2006.01)
*G03G 5/147* (2006.01)

(52) U.S. Cl.
CPC ..... *G03G 5/1476* (2013.01)

(58) Field of Classification Search
CPC ..... G03G 5/1476
USPC ..... 430/66
See application file for complete search history.

(56) References Cited

U.S. PATENT DOCUMENTS

2014/0199620 A1* 7/2014 Ishida ..... G03G 5/0596 430/57.1

FOREIGN PATENT DOCUMENTS

JP 2002-251030 A 9/2002
JP 2017-161777 A 9/2017

* cited by examiner

*Primary Examiner* — Mark A Chapman
(74) *Attorney, Agent, or Firm* — Lucas & Mercanti, LLP

(57) ABSTRACT

An electrophotographic photoreceptor includes a cured outermost layer that includes a polymerized cured product including at least an inorganic filler and a phenol derivative. The inorganic filler is surface-modified with a surface modifier. The phenol derivative has a structure represented by Formula (1).

Formula(1)

In Formula (1), $R_1$ and $R_3$ each independently represent an alkyl group having three or more carbon atoms, $R_2$ and $R_4$ each independently represent a hydrogen atom or an alkyl group having 1 to 10 carbon atoms, and $L_1$ represents a linking group having at least 10 atoms with an atomic number of 12 or more.

11 Claims, 3 Drawing Sheets

ELECTROPHOTOGRAPHIC PHOTORECEPTOR

CROSS-REFERENCE TO RELATED APPLICATIONS

The entire disclosure of Japanese Patent Application No. 2019-093140 filed on May 16, 2019 is incorporated herein by reference in its entirety.

BACKGROUND

Technological Field

The present invention relates to an electrophotographic photoreceptor. More specifically, the present invention relates to an electrophotographic photoreceptor with which a toner image having excellent scratch resistance and excellent image quality can be formed.

Description of the Related Art

In recent years, image forming apparatuses such as electrophotographic copying machines and printers are desired to have higher durability and to form higher quality images. Electrophotographic photoreceptors applicable to such higher durability and higher quality images are also required. Higher durability that can contributing sustainable society is desired more and more. In order to achieve photoreceptors having high durability, mechanical strength is particularly important. Mechanical strength such as abrasion resistance and scratch resistance are the largest factors that determine durability of photoreceptors. Furthermore, the high quality images are also desired to be maintained for a long time.

However, when the photoreceptor is used for a long time, discharge products and the like are generated, which results in a problem that image quality is lowered due to deterioration of the photoreceptor. Also, when the mechanical strength is simply increased, adhesion such as the discharge products are difficult to be removed, which results in a problem that images tends to be blurred.

For the purpose of reducing influences of the discharge products, an antioxidant has been proposed to be used. For example, JP 2017-161777A discloses a photoreceptor including a hindered phenol-based antioxidant having a large molecular weight, but does not disclose using a cured surface layer or inorganic filler. Therefore, there are problems regarding sufficiency of layer strength and ensurance of scratch resistance.

JP 2002-251030A discloses a photoreceptor including an antioxidant in a thermosetting surface layer. However, since the surface layer does not include inorganic filler, and therefore does not have sufficient scratch resistance.

SUMMARY

The present invention has been made in view of the above problems and circumstances, and the object of the present invention is to provide an electrophotographic photoreceptor that can achieve both layer strength (scratch resistance) and reduction in image blurring.

In the process of examining causes and solutions of the above problems, the present inventors have reached the present invention based on their findings that an electrophotographic photoreceptor capable of achieving both layer strength (scratch resistance) and reduction in image blurring can be provided when the electrophotographic photoreceptor has a cured outermost layer including a polymerized cured product including at least an inorganic filler that is surface-modified with a surface modifier and a phenol derivative having a specific structure.

To achieve at least one of the above-mentioned objects, an electrophotographic photoreceptor reflecting one aspect of the present invention includes a cured outermost layer that includes a polymerized cured product including at least an inorganic filler that is surface-modified with a surface modifier and a phenol derivative having a structure represented by Formula (1), Formula(1)

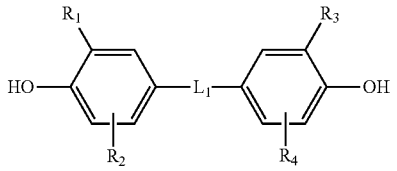

in Formula (1), $R_1$ and $R_3$ each independently represent an alkyl group having three or more carbon atoms, $R_2$ and $R_4$ each independently represent a hydrogen atom or an alkyl group having 1 to 10 carbon atoms, and $L_1$ represents a linking group having at least 10 atoms with an atomic number of 12 or more.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein.

DETAILED DESCRIPTION OF THE EMBODIMENTS

Figure 1A:
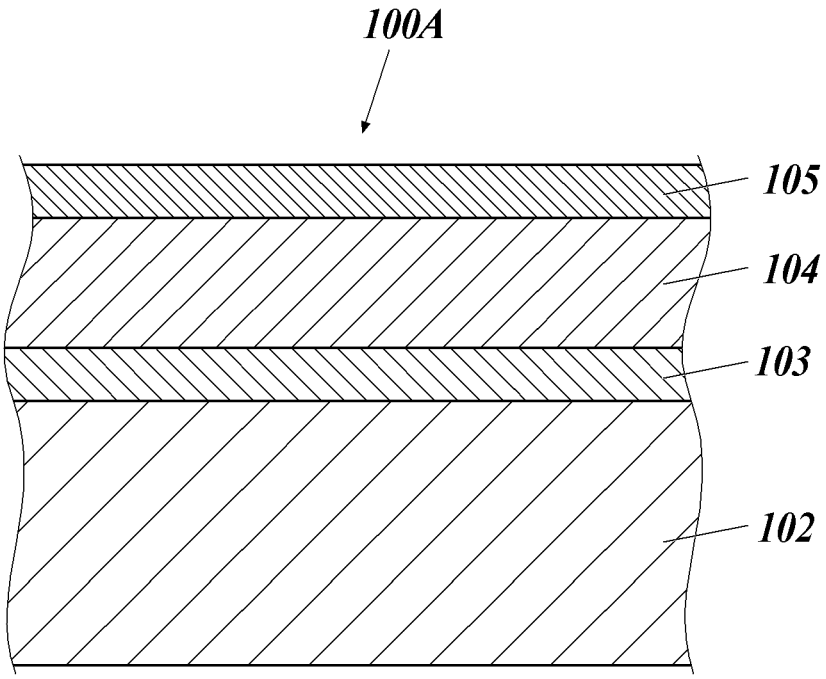
FIG. 1A is a cross-sectional view illustrating an example of a configuration of an electrophotographic photoreceptor according to the present invention.

The electrophotographic photoreceptor according to the present invention includes a cured outermost layer that includes a polymerized cured product including at least an inorganic filler that is surface-modified with a surface modifier and a phenol derivative having a structure represented by the Formula (1). This is a technical feature common to or corresponding to all the following embodiments.

As an embodiment of the present invention, from the viewpoint of exhibiting effects of the present invention, the surface modifier preferably includes a silicone chain, more preferably a side chain including a silicone chain, so that the inorganic filler is efficiently hydrophobized, highly compatible with the polymerizable monomer and the antioxidant, and thereby has improved dispersibility.

Furthermore, preferably, $R_1$ and $R_3$ in the Formula (1) each independently represent an alkyl group having four or more and eight or less carbon atoms, so that the curing inhibition is reduced. As a result, aggregation of the filler is suppressed while the hardness of the filler is maintained, which makes it possible to uniformly disperse the inorganic filler and the antioxidant in the outermost layer.

Furthermore, the inorganic filler surface-modified with the surface modifier preferably has a polymerizable group, such that the outermost layer having more excellent film strength (scratch resistance) can be formed.

Furthermore, the phenol derivative having a structure represented by the Formula (1) preferably has two phenol rings in one molecule, that is, the phenol derivative has no phenol ring in the linking group $L_1$ even in a side chain(s) (substituent group(s)). The phenol derivative having a structure represented by the Formula (1) also preferably has a cyclic acetal structure in the linking group $L_1$. The phenol derivative preferably has a structure compatible with the inorganic filler, so that the dispersibility of the inorganic filler is further improved.

The inorganic filler is preferably a composite fine particle having a conductive metal oxide attached to a surface of a core made of an insulating material, from the viewpoint of further exhibiting the effects of the present invention.

The mechanism by which the effects of the present invention is exhibited or exerted has not been revealed, but is assumed to be as follows.

The electrophotographic photoreceptor according to the present invention includes a cured outermost layer including a surface-modified inorganic filler and a phenol derivative having a structure represented by the Formula (1). As a result, while effects of the antioxidant is maintained, aggregation and curing inhibition of the inorganic filler can be reduced. As a result, it is possible to achieve both layer strength (scratch resistance) and reduction in image blurring.

Specifically, an antioxidant inhibits curing reaction when the outermost layer is cured with light. According to the present invention, a phenol derivative having a structure represented by Formula (1) has a bulky substituent and has a large number of atoms in the linking portion between the two phenol ring structures. When the phenol derivative is used as the antioxidant, curing of the inorganic filler can be less suppressed. Furthermore, when a large number of atoms bond the phenol rings, compatibility with the inorganic filler is also improved, aggregation of the inorganic filler is suppressed, and the original effect as an antioxidant is also exhibited. In particular, a phenol derivative having a cyclic acetal structure in the linking group is a highly stable compound because of the presence of a rigid portion, and can exhibit an effect as the antioxidant for a long time.

Furthermore, as the amount of the inorganic filler added to the outermost layer is increased, wear resistance and scratch resistance of the outermost layer can be improved. The cured outermost layer including an inorganic filler is likely to be strong but to cause image blurring. When an antioxidant is simply added to such an outermost layer for the purpose of image blurring reduction, layer strength is deteriorated due to inhibition of curing with light and aggregation of the inorganic filler, and scratch resistance therefore deteriorated. This is because radicals generated in curing the antioxidant are trapped, and the compatibility between the inorganic filler and the antioxidant is low.

In order to solve the above problems, an antioxidant applied to the outermost layer according to the present invention includes: an alkyl group having three or more carbon atoms at the ortho position of the phenol ring structure constituting the phenol derivative; and has a linking group $L_1$ between the two phenol rings including at least 10 atoms with an atomic number of 12 or more, for example, carbon, nitrogen, oxygen, phosphorus, sulfur, and the like. As a result, curing inhibition is reduced, and compatibility between the antioxidant and the surface-modified inorganic filler are both improved. Accordingly, aggregation of the filler is suppressed while the hardness of the filler is maintained, and the inorganic filler and the antioxidant can be uniformly dispersed in the outermost layer.

The reason that curing inhibition is reduced by the above configuration is assumed as follows.

The reactivity is lowered because of the bulky substituent at the ortho position of the phenol ring structure. In addition, the phenol derivative having the linking group L, with a large number of bonding atoms has less reaction points than a phenol derivative of the same volume having a linking group with fewer bonding atoms. On the other hand, when the phenol derivative having a linking group with a small number of bonding atoms is added at less amount so as to have less reaction points, the phenol derivative cannot sufficiently exhibit effects as an antioxidant.

It is considered that the dispersibility of the inorganic filler is also improved when the number of bonding atoms in the linking group $L_1$ between the phenol ring structures is large, because a hydrophobic site compatible with the surface-modified inorganic filler is formed.

Accordingly, it is possible to achieve both improvement of scratch resistance and reduction in image blurring by using a surface-modified inorganic filler and a phenol derivative having a structure represented by the Formula (1) in combination as in the present invention.

Hereinbelow, the present invention, components thereof, and embodiments and aspects for implementing the present invention will be described. However, the scope of the invention is not limited to the disclosed embodiments. In the present application, the term "to" between numerals is used to describe a numerical range including the numerical values written before and after the "to" as the lower limit and the upper limit.

<<Electrophotographic Photoreceptor>>

[Basic Configuration of Electrophotographic Photoreceptor]

The electrophotographic photoreceptor of the present invention has a cured outermost layer, and the outermost layer is a polymerized cured product including at least an inorganic filler surface-modified with a surface modifier and a phenol derivative having a structure represented by the Formula (1).

Figure 1B:
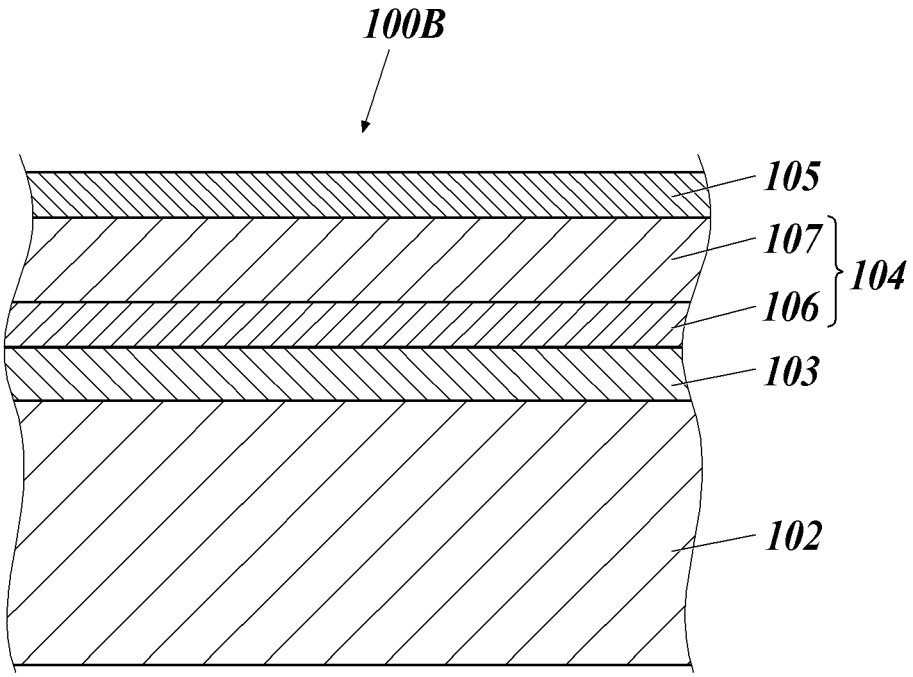
FIG. 1B is a cross-sectional view illustrating an example of a configuration of an electrophotographic photoreceptor according to the present invention.

FIG. 1A and FIG. 1B are cross-sectional views each illustrating an example of a configuration of an electrophotographic photoreceptor according to the present invention.

The electrophotographic photoreceptor (hereinafter, also simply referred to as a "photoreceptor") according to the present invention has at least a cured outermost layer having a configuration defined in the present invention.

FIG. 1A is a cross-sectional view illustrating an electrophotographic photoreceptor 10A of a first configuration in which an intermediate layer 103 is formed on a conductive support 102, a photosensitive layer 104 is provided thereon, and an outermost layer 105 according to the present invention forms the outermost surface. The outermost layer 105 is characterized by being configured with a polymerized cured product including at least an inorganic filler that is surface-modified with a surface modifier and a phenol derivative having a structure represented by the Formula (1).

FIG. 1B is a cross-sectional view illustrating an electrophotographic photoreceptor 10B of a second configuration in which an intermediate layer 103 is formed on a conductive support 102, a photosensitive layer 104 is provided thereon, and an outermost layer 105 according to the present invention forms the outermost surface. The photosensitive layer 104 is configured with a charge generating layer 106 and a charge transporting layer 107. The outermost layer 105 is configured with a polymerized cured product including an inorganic filler that is surface-modified with a surface modifier and a phenol derivative having a structure represented by the Formula (1).

[Components of Electrophotographic Photoreceptor]

Hereinafter, the main components of the electrophotographic photoreceptor of the present invention will be described in detail.

[1. Outermost Layer]

The outermost layer according to the present invention is mainly composed of a polymerized cured product including an inorganic filler that is surface-modified with a surface modifier, a phenol derivative having a structure represented by the Formula (1), and a polymerizable monomer.

Hereinafter, the components of the outermost layer according to the present invention will be described in detail.

(Inorganic Filler)

The inorganic filler applied to the outermost layer according to the present invention is characterized in that it has been surface-modified with a surface modifier.

The inorganic filler applied to the present invention is not particularly limited, and examples thereof include magnesium oxide, lead oxide, aluminum oxide, zinc oxide, tin oxide, tantalum oxide, indium oxide, bismuth oxide, yttrium oxide, cobalt oxide, copper oxide, manganese oxide, selenium oxide, iron oxide, zirconium oxide, germanium oxide, titanium dioxide, niobium oxide, molybdenum oxide, vanadium oxide, copper-aluminum composite oxide, tin oxide doped with antimony, and the like. Among these, aluminum oxide ($Al_2O_3$), tin oxide ($SnO_2$), titanium dioxide ($TiO_2$), and copper-aluminum composite oxide ($CuAlO_2$) are preferable.

The inorganic filler may be used alone or in combination of two or more kinds. Furthermore, the inorganic filler may be a synthetic product and/or a commercially available product.

<Composite Fine Particles Having Core-Shell Structure>

In a preferred embodiment, the inorganic filler according to the present invention forms composite fine particles in which conductive metal oxide is attached to a surface of cores made of an insulating material. That is, the inorganic filler is preferably composite fine particles each having a core-shell structure in which the surface of the core made of an insulating material has a shell made of the above-mentioned inorganic filler. When the inorganic filler does not have a core-shell structure but is composed of a single material, due to difference in refractive index from the polymerizable monomer which increases as the number average primary particle diameter increases, the permeability of actinic energy rays (particularly, ultraviolet rays) used for curing the outermost layer is lower than when the inorganic filler composed of composite particles having a core-shell structure. As a result, the layer strength of the outermost layer when the inorganic filler is composed of a single material after curing may be lower than when the inorganic filler is composed of composite particles. Furthermore, when the inorganic filler is a composite particle having a core-shell structure, the amount of the surface modifier on the surface of the composite particle can be increased. As a result, the dispersibility of the inorganic filler in the outermost layer is increased, and the permeability of actinic energy rays (particularly, ultraviolet rays) in the outermost layer can be also increased. Accordingly, the layer strength of the outermost layer after curing can be further increased, and the abrasion resistance, scratch resistance, and the like are further improved.

The material of the core constituting the composite particles having the core-shell structure is, for example, barium sulfate, aluminum oxide, and silica. The composite fine particle having a core-shell structure is preferably, for example, a composite particle having a core made of barium sulfate and a shell made of tin oxide. The ratio between the number average primary particle diameter of the core and the thickness of the shell may be set as appropriate depending on the materials of core and shell, and their combination.

<Surface Modification of Inorganic Filler with Surface Modifier>

A surface modification treatment with a surface modifier is applied to an untreated inorganic filler as a raw material, such that the inorganic filler surface-modified with the surface modifier according to the present invention is obtained.

The inorganic filler after the surface modification treatment with the surface modifier is assumed to become a surface-coated filler including a chemical species (coating layer) derived from the surface modifier and the inorganic filler. The surface-modified inorganic filler has only to have the chemical species (coating layer) derived from the surface modifier on at least a part of its surface.

The inorganic filler is efficiently hydrophobized in response to the surface modification with the surface modifier. The inorganic filler thus surface-modified is used together with a phenol derivative and a polymerizable monomer described below to prepare a composition that is to be polymerized and cured so as to prepare a product to form the outermost layer of the photoreceptor. The surface-modified inorganic filler prepared in this way is highly compatible with the polymerizable monomer and the antioxidant, and thereby advantageously dispersed.

In the present invention, conventionally known compound can be used as the surface modifier in the surface modification treatment of the inorganic filler without particular limitation, as long as it hydrophobizes the surface of the inorganic filler. Specific examples of the surface modifier include a silane coupling agent, a titanium coupling agent, a fluorine-based surface modifier, a surface modifier having a silicone chain, and the like.

In the present invention, from the viewpoint of dispersibility, the surface modifier is preferably a fluorine-based surface modifier or a surface modifier having a silicone chain, particularly preferably one having a silicone chain, and more particularly preferably one having a silicone chain in a side chain into which a polymer main chain branches. The surface modifier with a silicone chain in the side chain preferably has a silicone side chain into which an acrylic or silicone main chain branches.

When a surface modifier having a silicone chain is used, the inorganic filler is more efficiently hydrophobized, and the effect of improving the compatibility with the polymerizable monomer and the antioxidant is further exhibited. In particular, when modified with the surface modifier having a silicone chain in the side chain, the surface of the inorganic filler has a high concentration of silicone chains. The inorganic filler having a high concentration of silicone chains on its surface by the surface modification treatment is used together with a specific phenol derivative compound and a polymerizable monomer to prepare a composition. The composition can be used to form a polymerized cured product to form a surface layer of the photoreceptor having advantageous dispersibility.

From the viewpoint of further increasing the dispersibility, the polymer main chain of the surface modifier having a silicone chain in the side chain is preferably a methacrylate copolymer chain, a polymethacrylate main chain (also simply referred to as an "acryl main chain") having a repeating unit derived from a monomer represented by the following Formula (2), or a silicone main chain. The more the inorganic filler is dispersed in the outermost layer, the less likely the inorganic filler is to aggregate and the less likely the phenol derivative is to be unevenly dispersed. As a result, the outermost layer is further improved in wear resistance, scratch resistance, and the like.

Formula(2)

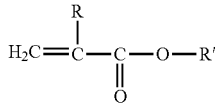

In above Formula (2), R represents a hydrogen atom or a methyl group, and R' represents an alkyl group having 1 to 6 carbon atoms.

The silicone chain of the side chain and the main chain preferably includes a dimethylsiloxane structure as a repeating unit. The number of the repeating units is preferably from 3 to 100, more preferably from 3 to 50, and even more preferably from 3 to 30, in both the side chain and the main chain. When the number of repeating units is three or more, both the side chain and the main chain can effectively exhibit the effects derived from the silicone surface modification treatment. When the number of repeating units is 100 or less, both the side chain and the main chain have good compatibility with the polymerizable monomer and have excellent dispersibility without aggregation or precipitation. The acrylic chain as the main chain preferably includes a structure derived from the above-described monomer as a repeating unit. The number of the repeating units is preferably from 3 to 100, more preferably from 3 to 50, and even more preferably from 3 to 30. When the number of repeating units is three or more, the main chain can effectively exhibit the effects derived from the silicone surface modification treatment. When the number of repeating units is 100 or less, the main chain has good compatibility with the polymerizable monomer and has excellent dispersibility without aggregation or precipitation.

The surface modifier may be used alone or in combination of two or more kinds. Furthermore, the surface modifier may be a synthetic product and/or a commercially available product. Specific examples of the commercially available surface modifier include, for example, the following compounds.

Silane coupling agent: KBM 502, KBM 503, KBM 5103, KBE-502 (all manufactured by Shin-Etsu Chemical Co., Ltd.), and the like Titanium coupling agent: ORGATIX TC-800 (Matsumoto Fine Chemical Co., Ltd.) and the like Fluorine-based surface modifier: Novec 1700, Novec 1720, Novec 2702 (all manufactured by 3M Company), and the like Surface modifier having silicone chain: KF-99 and KF-9901 (manufactured by Shin-Etsu Chemical Co., Ltd.; side chain type), Cymac US-350 (manufactured by Toagosei Co., Ltd.; side chain type, acrylic main chain), KP-541, KP-574, and KP-578 (manufactured by Shin-Etsu Chemical Co., Ltd.; side chain type, acrylic main chain), KF-9908 and KF-9909 (manufactured by Shin-Etsu Chemical Co., Ltd.; side chain type, silicone main chain), and the like <Inorganic Filler Having a Polymerizable Group>

In embodiments of the present invention, the inorganic filler surface-modified with the surface modifier to be applied preferably has a polymerizable group. The polymerizable group has a carbon-carbon double bond. The polymerizable group contained in the inorganic filler may be one kind or more. The groups to be polymerized may be the same or different. The polymerizable group contained in the inorganic filler may be the same as or different from the polymerizable group of the polymerizable monomer forming the polymerized cured product. The inorganic filler having a polymerizable group can be obtained, for example, by a surface modification treatment of the inorganic filler with a surface modifier that is a compound having a polymerizable group.

The inorganic filler surface-modified with the surface modifier according to the present invention preferably has a polymerizable group.

Because the inorganic filler having a polymerizable group is polymerized with the polymerizable monomer, mechanical strength can be easily obtained and the inorganic filler is less likely to fall off, so that the above-described effects can be easily exhibited for a long time.

Examples of a compound having a polymerizable group (a reactive organic group-containing surface modifier) include the followings.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OC_2H_5)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$

S-31: $CH_2{=}CHCOO(CH_2)_2Si(CH_3)_2(OCH_3)$

S-32: $CH_2{=}C(CH_3)COO(CH_2)_8Si(OCH_3)_3$

<Shape of Inorganic Filler>

The inorganic filler may have any shape without particular limitation, for example, a spherical shape, an elliptical shape in cross section, a needle shape, a disk shape, or an irregular shape. From the viewpoint of dispersibility and the like, a spherical shape or an elliptical shape in cross section is preferable.

<Characteristic Value of Inorganic Filler>

The number average primary particle diameter of the inorganic filler is preferably in the range of 10 to 200 nm, more preferably in the range of 20 to 150 nm. When the number average primary particle diameter of the inorganic filler is 10 nm or more, scratch resistance can be sufficient. When the number average primary particle diameter of the inorganic filler is 200 nm or less, the inorganic filler does not precipitate in the dispersion of inorganic filler dispersed in a solvent for forming the outermost layer, such that photosensitive member can be stably manufactured.

The number average primary particle diameter of the inorganic filler is defined to be measured by the following method.

First, a photograph of a sample (inorganic filler and the like) that is magnified at a magnification of 10000 times and imaged by a scanning electron microscope (manufactured by JEOL Ltd.) is captured by a scanner. Subsequently, from the obtained photographic image, images of randomly selected 300 inorganic filler particles excluding aggregated filler particles are binarized using an automatic image processing analyzing system LUZEX (registered trademark) AP software Ver. 1.32 (manufactured by Nireco Corp.) to calculate the horizontal Feret diameters from the respective particle images. Then, the horizontal Feret diameters calculated from each particle image is averaged and taken as the number average primary particle diameter. The horizontal Feret diameter is a length of a horizontal side of a circumscribed rectangle of each binarized inorganic filler particle image mentioned above. The measurement of the number average primary particle diameter is performed as to an inorganic filler that does not contain a chemical species (coating layer) derived from a surface modifier. Because the thickness of the chemical species (coating layer) derived from the surface modification treatment is considered to be within a margin of error with respect to the diameter of the inorganic filler (about 1/10,000 of the diameter of the inorganic filler), the number average primary particle diameter can be considered not to change by the surface modification treatment.

(Phenol Derivative Having Structure Represented by Formula (1))

The outermost layer according to the present invention includes, together with the inorganic filler, a phenol derivative having a structure represented by the following Formula (1).

Formula(1)

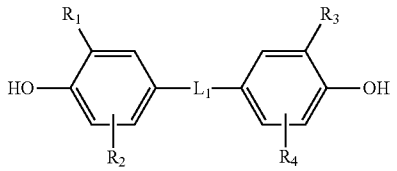

In above Formula (1), $R_1$ and $R_3$ each independently represent an alkyl group having three or more carbon atoms, and $R_2$ and $R_4$ each independently represent a hydrogen atom or an alkyl group having 1 to 10 carbon atoms. $L_1$ represents a linking group having at least 10 atoms with an atomic number of 12 or more. The number of atoms with an atomic number of 12 or more is counted in the main chain (longest portion) of the linking group $L_1$. When the main chain of the linking group L, has a cyclic compound, the number of atoms with an atomic number of 12 or more is counted in a longest structure through the cyclic compound. The number of atoms with an atomic number of 12 or more in the linking group $L_1$ preferably 30 or less from the viewpoint of stability of a coating solution for forming the outermost layer.

Preferably, in the phenol derivative having a structure represented by Formula (1), the alkyl group at the ortho-position of the phenol ring is a branched alkyl group having 4 to 8 carbon atoms. A branched alkyl group having 4 to 8 carbon atoms is more likely to exhibit a steric hindrance effect than a straight-chain alkyl group, thereby exhibits a higher effect of reducing curing inhibition. A branched alkyl group has 8 or more carbon atoms exerts a steric hindrance effect too much, and has a low effect as an antioxidant.

In the phenol derivative having a structure represented by Formula (1) according to the present invention, the number of phenol rings is preferably two in the whole molecule. That is, L, as a linking group preferably does not have a structure having a phenol ring, even in a side chain (as a substituent). When the number of phenol rings is three or more, the number of reactive point increases in the molecule. As a result, the effect of suppressing curing inhibition is reduced, the scratch resistance is deteriorated, and the durability of the effect as an antioxidant tends to be reduced.

More preferably, the phenol derivative has a cyclic acetal structure in the linking group $L_1$ so as to have maintained stability as the compound, and thereby to exert the effect as an antioxidant for a long time. It is not clear why the stability as a compound can be maintained, but the cyclic acetal structure is assumed to balance, as a molecule, rigidity or restraint and the degree of freedom.

The phenol derivative having a structure represented by Formula (1) according to the present invention is, for example, a compound having the following structures, but is not limited thereto.

P1

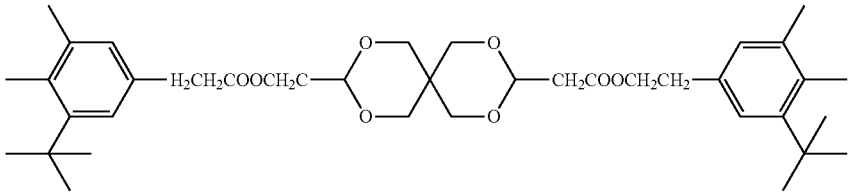

-continued

P2

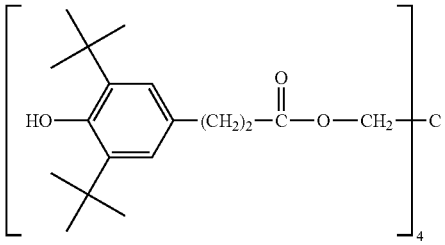

P3

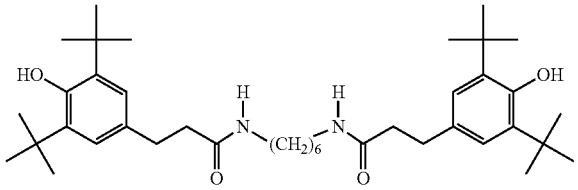

P4

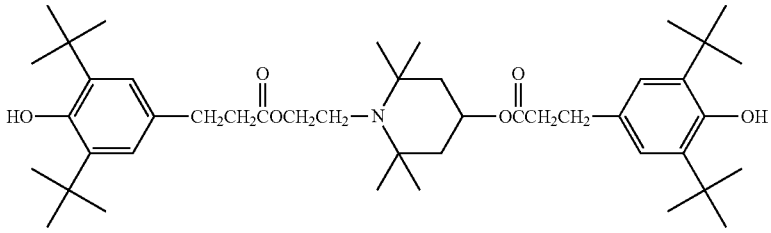

(Polymerizable Monomer)

The outermost layer according to the present invention is a layer disposed on the photosensitive layer and constituting the surface of the photoreceptor. The outermost layer according to the present invention is preferably configured with a polymerized cured product of a composition including an inorganic filler having a polymerizable group, a phenol derivative, and a polymerizable monomer. Thus, the outermost layer is formed of a polymer combined by polymerization of a polymerizable monomer, and has inorganic filler particles and the like dispersed therein. The inorganic filler particles and the like can be covalently bonded to the polymer by polymerization. Each of the polymerizable monomer and the inorganic filler may be used alone or in combination of two or more kinds. Hereinafter, materials composing the outermost layer will be described in detail.

The polymerizable monomer according to the present invention has a polymerizable group, and is polymerized (cured) by irradiation with actinic rays (ultraviolet rays, visible rays, electron beams, etc.) or by addition of energy such as heating to form a compound generally used as a binder for a photoreceptor. The polymerizable monomer is preferably cured through a radical polymerization reaction. Examples of the polymerizable monomer include a styrene monomer, an acrylic monomer, a methacrylic monomer, a vinyltoluene monomer, a vinyl acetate monomer, and an N-vinylpyrrolidone monomer. Examples of the binder resin include polystyrene and polyacrylate. The polymerizable monomer has a polymerizable group having a carbon-carbon double bond. The polymerizable group is particularly preferably an acryloyl group ($CH_2{=}CHCO{-}$) or a methacryloyl group ($CH_2{=}C(CH_3)CO{-}$), which can be cured with a small amount of light or in a short time. Specific examples of the polymerizable monomer include, but are not limited to, the following compounds M1 to M1. In each of the following formulas, R represents an acryloyl group, and R' represents a methacryloyl group.

M1

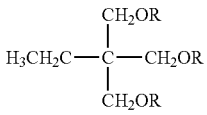

-continued

M2

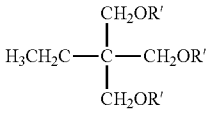

M3

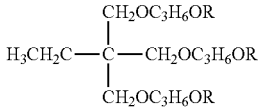

M4

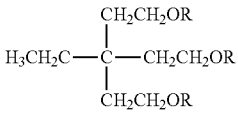

M5

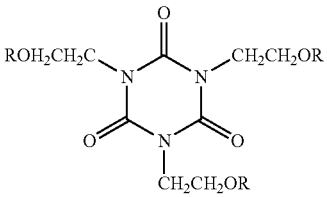

M6

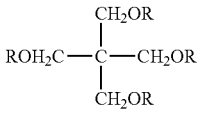

M7

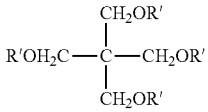

M8

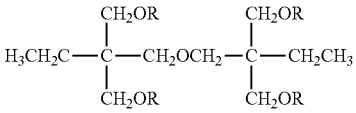

-continued

M9

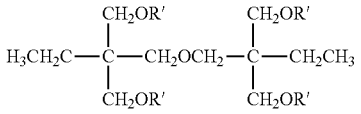

M10

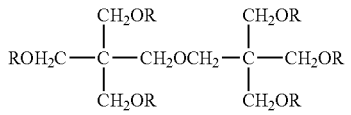

M11

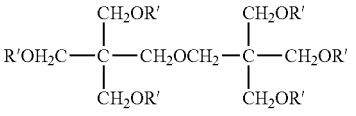

The polymerizable monomer may be synthesized by a known method, and/or a commercially available product.

The polymerizable monomer is preferably a compound having three or more polymerizable groups from the viewpoint of forming a hard outermost layer having a high crosslinking density.

Next, other components of the electrophotographic photoreceptor of the present invention will be described.

[2. Conductive Support]

The conductive support constituting the photoreceptor of the present invention is not particularly limited as long as it has conductivity, and examples thereof includes: a metal such as aluminum, copper, chromium, nickel, zinc, stainless steel, etc., shaped into drums or sheets; a plastic film laminated with metal foil such as aluminum and copper; a plastic film on which aluminum, indium oxide, tin oxide, etc. are deposited; and metal, plastic film and paper provided with a conductive layer by applying a conductive substance alone or together with a binder resin.

[3. Intermediate Layer]

The photoreceptor of the present invention may be provided with an intermediate layer having a barrier function and an adhesion function between the conductive support and the photosensitive layer. An intermediate layer is preferably provided in consideration of various failure preventions.

Such an intermediate layer includes, for example, a binder resin (hereinafter, also referred to as "binder resin for an intermediate layer") and, if necessary, conductive particles and metal oxide particles.

The binder resin for the intermediate layer is not particularly limited, and examples thereof include casein, polyvinyl alcohol, nitrocellulose, ethylene-acrylic acid copolymer, polyamide resin, polyurethane resin, and gelatin. Among these, a polyamide resin soluble in alcohol is preferable. The binder resins for the intermediate layer may be used alone or in combination of two or more kinds.

The intermediate layer can include various conductive particles and metal oxide particles to adjust the resistance. For example, various metal oxide particles such as alumina, zinc oxide, titanium oxide, tin oxide, antimony oxide, indium oxide, and bismuth oxide may be used. Furthermore, ultrafine particles of, for example, tin-doped indium oxide, antimony-doped tin oxide, and zirconium oxide may be used.

The number average primary particle diameter of such metal oxide particles is preferably 0.3 μm or less, more preferably 0.1 μm or less.

These metal oxide particles may be used alone or in combination of two or more kinds. When two or more kinds are combined, they may be in the form of solid solution or fusion.

The content ratio of the conductive particles or the metal oxide particles is preferably in the range of 20 to 400 parts by mass with respect to 100 parts by mass of the binder resin, more preferably in the range of 50 to 350 parts by mass.

The thickness of the intermediate layer is preferably in the range of 0.1 to 15 μm, more preferably in the range of 0.3 to 10 μm.

[4. Photosensitive Layer]

The photoreceptor of the invention has a photosensitive layer between the intermediate layer and the outermost layer. The photosensitive layer is composed of a charge generating layer and a charge transporting layer.

(Charge Generating Layer)

The charge generating layer in the photosensitive layer constituting the photoreceptor contains a charge generating substance and a binder resin (hereinafter, also referred to as "a binder resin for charge generating layer").

The charge generating substance is not particularly limited, but includes, for example, the followings: azo dye such as Sudan Red and Diane Blue; quinone pigment such as pyrenequinone and anthanthrone; quinocyanine pigment; perylene pigment; indigo pigment such as indigo and thioindigo; polycyclic quinone pigment such as pyranthrone and diphthaloylpyrene; and phthalocyanine pigment. Among these, polycyclic quinone pigments and titanyl phthalocyanine pigments are preferred. These charge generating substances may be used alone or in combination of two or more kinds.

The binder resin for charge generating layer may be any known resin without particular limitation, and examples thereof includes: polystyrene resin, polyethylene resin, polypropylene resin, acrylic resin, methacrylic resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, and copolymer resins containing two or more of these resins (for example, vinyl chloride-vinyl acetate copolymer resin, vinyl chloride-vinyl acetate-maleic anhydride copolymer resin), poly-vinyl carbazole resin, and the like. Among these, polyvinyl butyral resin is preferred. These binder resins for charge generating layer may be used alone or in combination of two or more kinds.

The content ratio of the charge generating substance in the charge generating layer is preferably in the range of 1 to 600 parts by mass with respect to 100 parts by mass of the binder resin for the charge generating layer, more preferably 50 to 500 parts by mass.

The preferred thickness of the charge generating layer depends on the characteristics of the charge generating substance, the characteristics and the content of the binder resin for charge generating layer, and the like, and is preferably in the range of approximately 0.01 to 5 μm, more preferably in the range of 0.05 to 3 m.

(Charge Transporting Layer)

The charge transporting layer in the photosensitive layer constituting the photoreceptor contains a charge transporting substance and a binder resin (hereinafter, also referred to as "binder resin for charge transporting layer").

The charge transporting substance of the charge transporting layer is a substance that transports charges (holes), and examples thereof include a triphenylamine derivative, a hydrazone compound, a styryl compound, a benzidine compound, a butadiene compound, and the like.

The charge transporting layer formed under the outermost layer preferably contains a charge transporting substance having high mobility and high molecular weight, and examples thereof include the following known compounds that may be used together: carbazole derivative, oxazole derivative, oxadiazole derivative, thiazole derivative, thiadiazole derivative, triazole derivative, imidazole derivative, imidazolone derivative, imidazolidine derivative, bisimidazolidine derivative, hydrazone compound, pyrazoline compound, oxazolone derivative, benzimidazole derivative, quinazoline derivative, benzofuran derivative, acridine derivative, phenazine derivative, aminostilbene derivative, triarylamine derivative, phenylenediamine derivative, stilbene derivative, poly-N-vinylcarbazole, poly-1-vinylpyrene, and poly-9-vinylanthracene. These compounds may be used alone or in combination of two or more kinds.

The binder resin for charge transporting layer may be known resins including, for example, polycarbonate resin, polyacrylate resin, polyester resin, polystyrene resin, styrene-acrylonitrile copolymer resin, polymethacrylate resin, styrene-methacrylate copolymer resin, and particularly preferably polycarbonate resin. More specifically, polycarbonate resin of a BPA (bisphenol A) type, BPZ (bisphenol Z) type, dimethyl BPA type, BPA-dimethyl BPA copolymer type, and the like are preferable in terms of crack resistance, abrasion resistance, and charging characteristics. These binder resins for charge transporting layer may be used alone or in combination of two or more kinds.

The content ratio of the charge transporting material in the charge transporting layer is preferably in the range of 10 to 500 parts by mass with respect to 100 parts by mass of the binder resin for charge transporting layer, more preferably in the range of 50 to 250 parts by mass.

The thickness of the charge transporting layer depends on the characteristics of the charge transporting material, the characteristics and the content of the binder resin for charge transporting layer, and the like, and is preferably in the range of approximately 5 to 40 μm, more preferably in the range of 10 to 30 m.

To the charge transporting layer may be added an antioxidant, an electronic conductive agent, a stabilizer, a silicone oil, and the like. The antioxidant is preferably those disclosed in JP2000-305291A, and the electronic conductive agent is preferably those disclosed in JPS50-137543A and JPS58-76483A.

<<Manufacturing Method of Electrophotographic Photoreceptor>>

The manufacturing method of the photoreceptor of the present invention includes a step of forming an uncured layer including a polymerizable compound on a photosensitive layer on a conductive support, and a step of forming the outermost layer including a cured resin by irradiating the uncured layer with light. Further steps of the manufacturing method of the photoreceptor are not limited, but preferably includes the following steps.

Step (1): A step of forming the intermediate layer by applying a coating liquid for forming the intermediate layer on the outer peripheral surface of the conductive support, and by drying the coating liquid Step (2): A step of forming the charge generating layer by applying a coating liquid for forming the charge generating layer on the outer peripheral surface of the conductive support or on the outer peripheral surface of the intermediate layer formed on the conductive support in step (1), and by drying the coating liquid Step (3): A step of forming the charge transporting layer by applying a coating liquid for forming the charge transporting layer on the outer peripheral surface of the conductive support or on the outer peripheral surface of the charge generating layer formed on the intermediate layer and by drying the coating liquid Step (4): A step of forming the outermost layer by applying a coating liquid for forming the outermost layer on the outer peripheral surface of the charge transporting layer formed on the charge generating layer, and by performing polymerization and curing treatment The concentration of each component in the coating liquid used for forming each layer is appropriately determined depending on the thickness and the production rate of each layer.

In the coating liquid for forming each layer, particles such as conductive particles and metal oxide particles, charge generating substances, and the like can be dispersed using an ultrasonic disperser, a ball mill, a sand mill, a homomixer, and the like, but are not limited thereto.

The coating liquid for forming each layer may be applied by any known method without particular limitation, for example, an immersion coating method, a spray coating method, a spinner coating method, a bead coating method, a blade coating method, a beam coating method, a slide hopper method, and a circular slide hopper method.

The drying method of the applied layer can be appropriately determined depending on the kind of the solvent and the layer thickness, and is preferably a thermal drying or natural drying.

Hereinafter, the steps of forming each layer will be described in detail.

<Step (1): Formation of Intermediate Layer>

The intermediate layer is formed as follows. A binder resin for intermediate layer is dissolved in a solvent to prepare a coating liquid for forming the intermediate layer, and other components such as conductive particles, metal oxide particles, a dispersant, and a leveling agent are dispersed or dissolved in the coating liquid as needed. After that, the coating liquid is applied to the conductive support to form an applied layer having a certain thickness, and the applied layer is dried to obtain the intermediate layer.

The coating liquid for forming the intermediate layer is preferably applied by the immersion coating method.

The solvent preferably used in the step of forming the intermediate layer appropriately disperses the conductive particles and metal oxide particles, and dissolves the binder resin for intermediate layer, particularly the polyamide resin. Preferred solvents having excellent solubility of a polyamide resin and excellent coating performance are alcohols having 1 to 4 carbon atoms specifically including methanol, ethanol, n-propyl alcohol, isopropyl alcohol, n-butanol, tert-butanol, sec-butanol (2-butanol), and the like. A cosolvent may be used in combination with the solvent to improve the storage stability, dispersibility of the particles, and the like. Examples of the co-solvent that exhibits a preferable effect include benzyl alcohol, toluene, dichloromethane, cyclohexanone, and tetrahydrofuran.

<Step (2): Formation of Charge Generating Layer>

The charge generating layer is formed as follows. A charge generating substance is dispersed in a solution in which a binder resin for charge generating layer is dissolved to prepare a coating liquid for forming the charge generating layer. The coating liquid is applied to the intermediate layer to form an applied layer having a certain thickness, and the applied layer is dried to obtain the charge generating layer.

The coating liquid for forming the charge generating layer is preferably applied by the immersion coating method.

The solvent preferably used in the step of forming the charge generating layer includes, but not limited to, toluene, xylene, dichloromethane, 1,2-dichloroethane, methyl ethyl ketone, cyclohexane, ethyl acetate, tert-butyl acetate, methanol, ethanol, n-propyl alcohol, isopropyl alcohol, n-butanol, tert-butanol, sec-butanol (2-butanol), methyl cellosolve, 4-methoxy-4-methyl-2-pentanone, ethyl cellosolve, tetrahydrofuran, 1-dioxane, 1,3-dioxolan, pyridine, diethylamine, and the like.

<Step (3): Formation of Charge Transporting Layer)

The charge transporting layer is formed as follows. A binder resin for charge transporting layer and a charge transporting substance are dissolved in a solvent to prepare a coating liquid for forming the charge transporting layer. The coating liquid is applied to the charge generating layer to form an applied layer having a certain thickness, and the applied layer is dried to obtain the charge transporting layer.

The coating liquid for forming the charge transporting layer is preferably applied by the immersion coating method.

The solvent preferably used in the step of forming the charge transporting layer includes, but not limited to, toluene, xylene, dichloromethane, 1,2-dichloroethane, methyl ethyl ketone, cyclohexanone, ethyl acetate, butyl acetate, methanol, ethanol, n-propyl alcohol, isopropyl alcohol, n-butanol, tert-butanol, sec-butanol (2-butanol), tetrahydrofuran, 1,4-dioxane, 1,3-dioxolan, pyridine, diethylamine, and the like.

<Step (4): Formation of Outermost Layer>

The outermost layer is formed as follows, for example. Inorganic filler that has been surface-modified with a surface modifier (preferably a surface modifier having a polymerizable group), a phenol derivative having a structure represented by Formula (1) of the present invention, and other components (a polymerization initiator, specific radical scavenger, lubricant, charge transport material, and the like) as necessary are added to a known solvent to prepare a coating liquid for forming the outermost layer. The coating liquid for forming the outermost layer is applied to the outer peripheral surface of the charge transporting layer formed in step (3) to form an applied layer. The applied layer is dried and irradiated with actinic rays such as ultraviolet rays and electron beams so that the polymerizable compound component in the applied layer is polymerized and cured, to obtain the outermost layer.

The coating liquid for forming the outermost layer is preferably applied using a circular slide hopper coating device, for example, by a slide hopper method disclosed in, JP2015-114454A.

Any solvent may be used in the step of forming the outermost layer as long as it can dissolve or disperse the polymerizable compound, metal oxide particles, and the like, and examples of them include, but are not limited to, methanol, ethanol, n-propyl alcohol, isopropyl alcohol, n-butanol, tert-butanol, sec-butanol (2-butanol), benzyl alcohol, toluene, xylene, dichloromethane, methyl ethyl ketone, cyclohexane, ethyl acetate, butyl acetate, methyl cellosolve, ethyl cellosolve, tetrahydrofuran, 1-dioxane, 1,3-dioxolan, pyridine, diethylamine, and the like.

The method of polymerizing the polymerizable compound is not particularly limited, and examples thereof include polymerization reaction by electron beam cleavage, polymerization reaction with light or heat by adding a radical polymerization initiator, and the like.

The cured resin component is obtained by a curing treatment including: irradiating the applied layer with actinic rays; generating radicals for polymerization reaction; and curing by a cross-linking reaction to form intramolecular and/or intermolecular cross-links. The actinic rays are preferably ultraviolet rays and electron beams, and ultraviolet rays are easy to use and particularly preferred.

The ultraviolet light source can be used without limitation as long as it emits ultraviolet rays. For example, a low-pressure mercury lamp, a medium-pressure mercury lamp, a high-pressure mercury lamp, an ultra-high-pressure mercury lamp, a carbon arc lamp, a metal halide lamp, a xenon lamp, a flash (pulse) xenon, or the like can be used.

Irradiation conditions are determined depending on the light source, and the irradiation amount of the actinic ray is preferably in the range of 5 to 500 $mJ/cm^2$, more preferably in the range of 5 to 100 $mJ/cm^2$.

The power of the light source is preferably in the range of 0.1 to 5 kW, more preferably in the range of 0.5 to 4 kW, and even more preferably in the range of 0.5 to 3 kW.

The required amount of actinic rays is preferably emitted for an irradiation time of 0.1 seconds to 10 minutes, more preferably 0.1 second to 5 minutes from the viewpoint of working efficiency.

In the step of forming the outermost layer, drying can be appropriately performed at a timing before, during, or after actinic ray irradiation, or at timings determined by combining them.

(Curing Device and Conditions of Outermost Layer)

In the present invention, the light irradiation conditions after forming the outermost layer are determined so as to adjust the surface hardness in the major axis direction of the photoreceptor.

The light source can change the surface hardness of the photoreceptor by changing (i) the irradiation amount or (ii) the irradiation time because the surface hardness is correlated with an integrated irradiation amount of light reaching the photoreceptor that is calculated as follows:

(Integrated Irradiation Amount of Light)=(Irradiation Amount of Light per Unit Area of Photoreceptor Drum Surface)×(Irradiation Time per Unit Area)

For example, when a target of the photoreceptor at the bottom is pulled up, a light source described in JP2013-57787A can change (i) the irradiation intensity of light or (ii) the pulling rate of the target (that is, irradiation time) at an any position. As a result, the integrated irradiation amount of light on the photoreceptor drum surface can be changed in the major axis direction of the photoreceptor, and the surface hardness of the photoreceptor can be changed. In particular, (ii) the pulling rate of the target is easily controlled and is preferable.

<<Electrophotographic Image Forming Method>>

An electrophotographic image forming method related to the present invention includes at least:

1) a charging step to charge the surface of the electrophotographic image photoreceptor;

2) an exposing step to expose the surface of the electrophotographic photoreceptor to form an electrostatic latent image;

3) a developing step to visualize the electrostatic latent image with toner to form a toner image; and 4) a transferring step to transfer the toner image to a transfer medium.

The electrophotographic image photoreceptor used in above 1) to 4) is the electrophotographic image photoreceptor according to the present invention.

If necessary, the following steps may be further included:
5) a cleaning step to remove residual toner; and
6) an ionization step to remove the residual charges;

The electrophotographic photoreceptor according to the present invention (hereinafter, also simply referred to as a photoreceptor) can be used in various known electrophotographic image forming methods, for example, in a monochrome image forming method or a full-color image forming method. A full-color image forming method may be a four-cycle image forming method using four color developing devices for yellow, magenta, cyan, and black, and one photoreceptor, or a tandem type image forming method using image forming units mounted for respective colors and each having a color developing device and a photoreceptor.

The photoreceptor according to the present invention is used in the electrophotographic image forming method of the present invention. Specifically, a toner image is obtained by charging the photoreceptor with a charging device (charging step), forming an electrostatic latent image through exposure of the image (exposing step), and developing and visualizing the electrostatic latent image with a developing device (developing step). This toner image is transferred onto a transfer medium such as a copy sheet or a transfer belt (transferring step), and then, after the ionization step, the next image forming cycle is performed. The toner image transferred onto a transfer medium such as a transfer belt is further transferred onto a copy sheet and then fixed thereon through a contact heating fixing method, for example, so as to be visualized. After the transferring step, the toner remaining on the photoreceptor (transfer residual toner) is removed (cleaning step) with a rubber blade or the like. This cleaning step may be performed either before or after the ionization step, but preferably before photoionization as the ionization step so that the light for ionization is not absorbed by toner remaining on the photoreceptor and can effectively remove charges.

In the ionization step, charges may be removed either with alternating current (AC ionization) or with light (photoionization). AC ionization requires an AC power supply which causes problems related to a space and a large-scale device. Therefore, photoionization is preferable.

<<Electrophotographic Image Forming Apparatus>>

Next, the electrophotographic image forming method using an electrophotographic image forming apparatus will be described.

An electrophotographic image forming apparatus according to the present invention using the photoreceptor of the present invention includes: a charging means that charges the photoreceptor with a charging device; an exposing means that forms an electrostatic latent image formed through exposure of the image; a developing means that develops and visualize the electrostatic latent image with a developing device to obtain a toner image; a transferring means that transfers the toner image onto a transfer medium such as a sheet or a transfer belt, and an ionization means. A fixing means fixes, through a contact heating method of fixing on a copy sheet, the toner image transferred onto the copy sheet directly or via a transfer medium such as a transfer belt to obtain a visible image. After the transfer, a cleaning means such as the cleaning blade removes the toner remaining on the photoreceptor (transfer residual toner).

Figure 2:
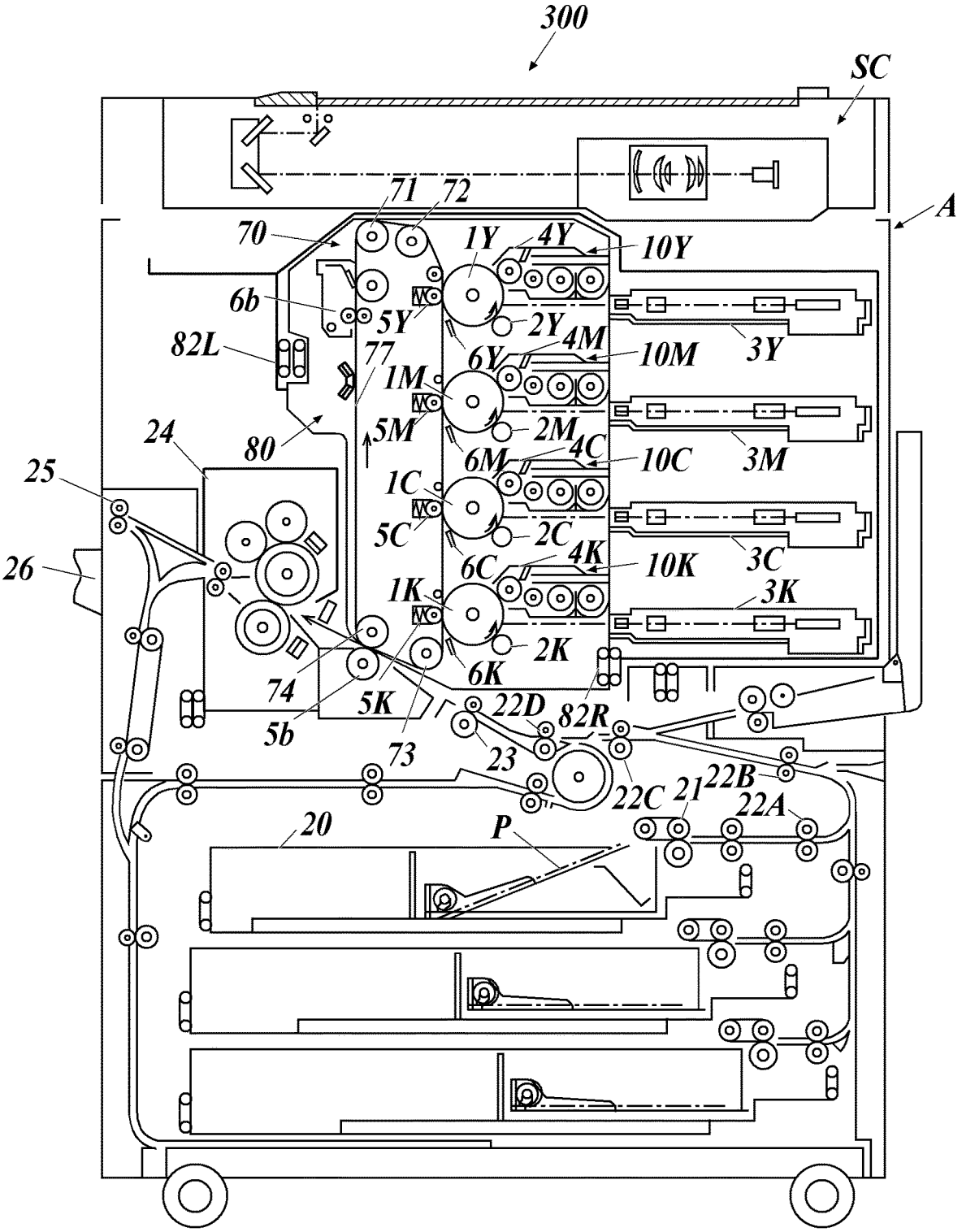
FIG. 2 is a schematic view illustrating an example of an overall configuration of a tandem-type electrophotographic image forming apparatus including the electrophotographic photoreceptor of the present invention.

FIG. 2 is a schematic view illustrating a structure of a tandem type electrophotographic image forming apparatus provided with the electrophotographic photoreceptor of the present invention.

The image forming apparatus 300 in FIG. 2 is called a tandem type color image forming apparatus, and includes four image forming units 10Y, 10M, 10C, and 10K, an intermediate transfer body unit 70, a sheet feeding unit 21, and a fixing means 24. A scanner SC that reads an original image is disposed at the top of the main body A of the electrophotographic image forming apparatus.

The four image forming units 10Y, 10M, 10C, and 10K are configured with photoreceptors 1Y, 1M, 1C, and 1K around which the followings are arranged: charging means 2Y, 2M, 2C, and 2K; exposing means 3Y, 3M, 3C, and 3K; rotatable developing means 4Y, 4M, 4C, and 4K; primary transfer rollers 5Y, 5M, 5C, and 5K as primary transfer means; and cleaning means 6Y, 6M, 6C, and 6K that cleans the photoreceptors 1Y, 1M, 1C, and 1K.

The photoreceptors 1Y, 1M, 1C, and 1K used in the electrophotographic image forming apparatus according to the present invention are the above-described photoreceptor according to the present invention.

The image forming units 10Y, 10M, 10C, and 10K have the same configuration except that they are provided with toner having different colors, i.e., yellow (Y), magenta (M), cyan (C), and black (K). Therefore, the image forming unit 10Y will be described in detail below as an example.

The image forming unit 10Y includes, around the photoreceptor 1Y as an image forming body, the charging means 2Y, the exposing means 3Y, the developing means 4Y, and the cleaning means 6Y, and forms a yellow (Y) toner image on the photoreceptor 1Y.

The charging means 2Y negatively and uniformly charges the surface of the photoreceptor 1Y. The electrophotographic image forming apparatus according to the present invention preferably includes a charging roller as the charging means 2Y.

The exposing means 3Y exposes the photoreceptor 1Y uniformly charged by the charging means 2Y, according to an image signal (yellow) to form an electrostatic latent image corresponding to a yellow image. The exposure means 3Y may be a means that includes an LED in which light emitting elements are arranged in an array in the major axial direction of the photoreceptor 1Y and an imaging element, or a laser optical system.

The developing means 4Y includes a developing sleeve that incorporates a magnet, for example, to hold a developer and rotates, and a voltage applying device that applies a DC and/or AC bias voltage between the developing sleeve and the photoreceptor.

The fixing means 24 is of a heat roller fixing type and includes, for example, a heating roller that incorporates a heating source and a pressure roller that presses the heating roller so as to form a fixing nip at the heating roller.

The cleaning unit 6Y includes a brush roller and a cleaning blade provided in this order along the rotating direction of the photoreceptor.

The image forming apparatus 300 may include a process cartridge (image forming unit) in which components such as the developing means, and the cleaning means are combined with the photoreceptor. The image forming unit may be detachably disposed on the apparatus main body. The process cartridge (image forming unit) may support at least one of the charging means, the exposing means, the developing means, the transferring means, and the cleaning means combined with the photoreceptor. Such a single image forming unit is detachably disposed using a guide means such as a rail of the apparatus main body.

The endless belt-shaped intermediate transfer body unit has a semiconductive endless belt-shaped second image carrier (endless belt-shaped intermediate transfer body 77) that is wound around and rotatably supported by a plurality of rollers.

The image forming units 10Y, 10M, 10C and 10K form images of respective colors that are sequentially transferred onto the rotating endless belt-shaped intermediate transfer body 77 via the primary transfer rollers 5Y, 5M, 5C and 5K as primary transfer means, and a combined color image is formed. A transfer material P (an image support such as a plain sheet, a transparent sheet, or the like on which a final image is fixed) accommodated in a sheet cassette 20 is fed by a sheet feeding unit 21, conveyed through a plurality of intermediate rollers 22A, 22B, 22C, and 22D, and a registration roller 23 to a secondary transfer roller 5*b* as the secondary transfer means. A color image is transferred to the transfer material P at one time by secondary transfer. The fixing unit 24 fixes the color image transferred to the transfer material P, and the transfer material P is sandwiched by sheet discharge rollers 25 and placed on a sheet discharge tray 26 outside the image forming apparatus. Here, a transfer support of a toner image formed on a photoreceptor such as an intermediate transfer body or a transfer material is generically referred to as the transfer medium.

After the color image is transferred to the transfer material P using the secondary transfer roller 5*b* as the secondary transfer unit, the transfer material P is curvature-separated from the endless belt-shaped intermediate transfer body 77. The cleaning means 6*b* removes the residual toner from the endless belt-shaped intermediate transfer body 77.

During the image forming process, the primary transfer roller 5K is always in contact with the photoreceptor 1K. The other primary transfer rollers 5Y, 5M, and 5C contact the corresponding photoreceptors 1Y, 1M, and 1C only during a colored image forming process.

The secondary transfer roller 5*b* comes into contact with the endless belt-shaped intermediate transfer body 77 only during the secondary transfer such that the transfer material P passes through the secondary transfer roller 5*b*.

A housing 80 can be pulled out of the apparatus main body A through supporting rails 82L and 82R.

The housing 80 includes the image forming units 10Y, 10M, 10C, and 10K and the endless belt-shaped intermediate transfer body unit 70.

The image forming units 10Y, 10M, 10C and 10K are arranged in tandem in the vertical direction. The endless belt-shaped intermediate transfer unit 70 is arranged on the left side of the photoreceptors 1Y, 1M, 1C and 1K in FIG. 2. The endless belt-shaped intermediate transfer body unit 70 includes an endless belt-shaped intermediate transfer body 77 that winds and loops around rollers 71, 72, 73, and 74, the primary transfer rollers 5Y, 5M, 5C, and 5K, and the cleaning means 6*b*.

<<Toner and Developer>>

A "toner base particle" related to the present invention constitutes the base of a "toner particle." The "toner base particle" includes at least a binder resin and a colorant, and may further contain other components such as a release agent (wax) and a charge control agent, if necessary. The "toner base particles" to which the external additive has been added are referred to as "toner particles". A collection of "toner particles" is referred to as a "toner."

The toner used in the image forming apparatus of the present invention is not particularly limited, and may be any known toner.

The toner may be either a pulverized toner or a polymerized toner, but is preferably a polymerized toner from the viewpoint of obtaining a high quality image.

The average particle diameter of the toner particle is not particularly limited, but a volume-based median diameter of the toner particle is preferably in the range of 2 to 8 μm, which can improves the resolution of the obtained image.

An appropriate amount of an external additive can be externally added to the toner base particles. Examples of the external additive include inorganic particles such as silica and titania having an average particle diameter of about 10 to 300 nm, an abrasive having an average particle diameter of about 0.2 to 3 μm, and the like.

A carrier used when the toner is used as a two-component developer may be magnetic particles of a conventionally known material, for example, a ferromagnetic metal such as iron, an alloy of a ferromagnetic metal, aluminum, and lead, and compounds of ferromagnetic metals such as ferrite and magnetite. Among these, ferrite is particularly preferred.

The carrier is more preferably coated with a resin, or a so-called resin-dispersed carrier in which magnetic particles are dispersed in a resin. The resin composition for coating is not particularly limited, and is preferably, for example, a cyclohexyl methacrylate-methyl methacrylate copolymer.

The volume-based median diameter of the carrier is preferably in the range of 15 to 100 μm, more preferably in the range of 25 to 60 μm.

The toner is preferably included in the two-component developer in the range of 4.0 to 8.0% by mass.

Although the embodiments of the present invention have been specifically described above, the embodiments of the present invention are not limited to the above examples, and various modifications can be made.

EXAMPLES

Hereinafter, the present invention will be described specifically with reference to Examples, but the present invention is not limited thereto. Unless otherwise specified, the terms "parts" and "%" used in the examples respectively mean "parts by mass" and "% by mass," and each operation was performed at room temperature (25° C.).

<<Preparation of Surface-Modified Inorganic Filler>>

[Preparation of Composite Particle C-1 (Core-Shell Particle)]

Figure 3:
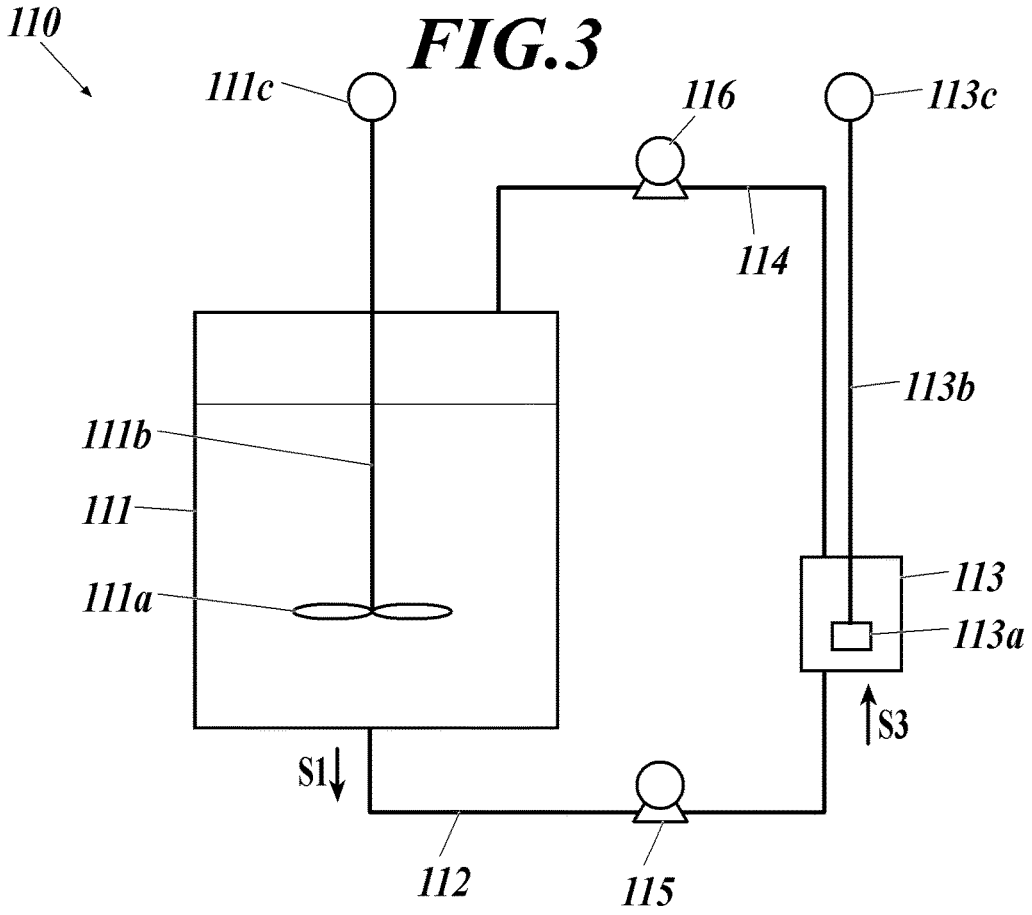
FIG. 3 is a schematic view illustrating an example of a device for manufacturing fine particles that is used for manufacturing composite particles used in an example of the present invention.

Composite particles C-1 constituted by forming a tin oxide outer shell on the surface of barium sulfate as a core particle was prepared using the fine particle producing apparatus shown in FIG. 3.

Specifically, 3500 mL of pure water was poured into a base liquid tank 111 shown in FIG. 3, then 900 g of a spherical core material of barium sulfate having an average particle diameter $D_{50}$ of 100 nm was added, and circulation was performed for 5 cycles. The flow rate of a slurry flowing out of the base liquid tank 111 was 2280 mL/min. The stirring rate of a strong dispersion device 113 was set to 16000 rpm.

After completion of the circulation, the slurry was diluted with pure water up to a total volume of 9000 mL. 1600 g of sodium stannate and 2.3 mL of an aqueous sodium hydroxide solution (normality: 25N) were added to the tank. After further circulation for 5 cycles, a base liquid was prepared.

Next, while circulating the base liquid so as to flow out of the base liquid tank 111 at a flow rate S1 of 200 mL/min, 20% by mass of sulfuric acid was supplied to the strong dispersing apparatus 113 (homogenizer magic LAB® manufactured by IKA Japan Inc.) at a supply rate S3 of 9.2 mL/min. The volume of the homogenizer was 20 $cm^3$, and the stirring rate was 16000 rpm. During circulation for 15 minutes, sulfuric acid was continuously supplied to the homogenizer. Thus, core-shell type particles having a coating layer (shell layer) of tin oxide formed on the surface of the barium sulfate core material were obtained. The slurry including the obtained particles was resuspended and washed until the conductivity became 600 μS/cm or less, and filtered by Nutsche filtration. A cake was thereby obtained.

The cake was dried at 150° C. in the air for 10 hours. The obtained dried cake was pulverized, and the pulverized powder was reduced and fired at 450° C. for 45 minutes in an atmosphere of 1 volume % $H_2/N_2$. Thus, composite particles C-1 having a number average primary particle diameter of 100 nm in which a tin oxide shell (shell layer) was formed on the surface of the barium sulfate core material were prepared.

Here, in the manufacturing device in FIG. 3, reference numerals 112 and 114 each denote a circulation pipe that forms a circulation path between the base liquid tank 111 and the strong dispersion device 113, and reference numerals 115 and 116 denote pumps provided on the circulation pipes 112 and 114, respectively. Reference numeral 11*a* indicates a stirring blade, reference numeral 13*a* indicates a stirring portion, reference numerals 111*b* and 113*b* indicate shafts, and reference numerals 111*c* and 113*c* indicate motors.

[Preparation of Surface-Modified Inorganic Filler F-1]

20 g of tin oxide (number average primary particle diameter=100 nm) as a base was added to 40 mL of methanol, and dispersed therein for 120 minutes using an ultrasonic homogenizer. Next, 1 g of 3-methacryloxypropyltrimethoxysilane (KBM503 (product name) manufactured by Shin-Etsu Chemical Co., Ltd.) as a reactive organic group-containing surface modifier having a polymerizable group and 40 mL of toluene were added thereto, followed by stirring for two hours at room temperature. After removing solvent with an evaporator and heating at 120° C. for 1 hour, inorganic filler having a polymerizable group by surface modification with the reactive organic group-containing surface modifier (KBM503) was obtained. 10 g of the obtained filler having a polymerizable group was added to 100 mL of 2-butanol and dispersed therein for 60 minutes using an ultrasonic homogenizer. Next, 0.3 g of triethoxysilylethyl polydimethylsiloxyethyl dimethicone (KF-9908 (product name) manufactured by Shin-Etsu Chemical Co., Ltd.) as a surface modifier having a silicone main chain with a silicone side chain was added to the dispersion and further dispersed therein for 60 minutes using an ultrasonic homogenizer. The dispersion was followed by volatilization of solvent at room temperature and further drying processing at 80° C. for 60 minutes, inorganic filler F-1 having a polymerizable group derived from the reactive organic group-containing surface modifier and having a surface modified with a surface modifier having a silicone main chain with a silicone side chain was prepared.

[Preparation of Surface-Modified Inorganic Fillers F-2 to F-8]

Surface-modified inorganic fillers F-2 to F-8 were prepared in the same manner as the above-described surface-modified inorganic filler F-1 except that the base of the inorganic filler and the surface modifier were changed as described in TABLE I.

[Preparation of Surface-Modified Inorganic Filler F-9]

10 g of the above composite particles C-1 as abase was added to 20 mL of 2-butanol and dispersed therein for 60 minutes using an ultrasonic homogenizer. Next, 0.3 g of triethoxysilylethyl polydimethylsiloxyethyl dimethicone (KF-9908 (product name) manufactured by Shin-Etsu Chemical Co., Ltd.) as a surface modifier having a silicone main chain with a silicone side chain was added to the dispersion and further dispersed therein for 60 minutes using an ultrasonic homogenizer. The dispersion was followed by volatilization of solvent at room temperature and further drying processing at 80° C. for 60 minutes, and inorganic filler F-9 having a surface modified with the surface modifier having a silicone main chain with a silicone side chain was prepared. The surface-modified inorganic filler F-9 did not have a surface modified with the surface modifier of a compound having a reactive organic group-containing.

[Preparation of Surface-Modified Inorganic Filler F-10]

20 g of the above composite particles C-1 as a base was added to 40 mL of methanol and dispersed therein for 120 minutes using an ultrasonic homogenizer. Next, 1 g of 3-methacryloxypropyltrimethoxysilane (KBM503 (product name) manufactured by Shin-Etsu Chemical Co., Ltd.) as a reactive organic group-containing surface modifier having a polymerizable group and 40 mL of toluene were added thereto, followed by stirring for two hours at room temperature. After removing solvent with an evaporator and heating at 120° C. for one hour, inorganic filler F-10 having a polymerizable group derived from the reactive organic group-containing surface modifier was obtained. The surface of the surface-modified inorganic filler F-10 is modified only by the reactive organic group-containing surface modifier having a polymerizable group.

TABLE I

| Inorganic Filler No. | Base of Inorganic Filler | Surface Modifier 1 | Surface Modifier 2 |
|---|---|---|---|
| F- 1 | $SnO_2$ | KF-9908 | KBM-503 |
| F- 2 | $TiO_2$ | KF-9908 | KBM-503 |
| F- 3 | Composite Particle C-1($SnO_2/BaSO_4$) | KF-9908 | KBM-503 |
| F- 4 | Composite Particle C-1($SnO_2/BaSO_4$) | KF - 99 | KBM-503 |
| F- 5 | Composite Particle C-1($SnO_2/BaSO_4$) | KF-9909 | KBM-503 |
| F- 6 | Composite Particle C-1($SnO_2/BaSO_4$) | KP- 574 | KBM-503 |
| F- 7 | Composite Particle C-1($SnO_2/BaSO_4$) | KP- 578 | KBM-503 |
| F- 8 | Composite Particle C-1($SnO_2/BaSO_4$) | Novec2702 | KBM-503 |
| F- 9 | Composite Particle C-1($SnO_2/BaSO_4$) | KF-9908 | — |
| F- 10 | Composite Particle C-1($SnO_2/BaSO_4$) | KBM- 503 | — |

Details of the surface modifiers having product names described in Table I are as follows.

KF-9908: triethoxysilylethyl polydimethylsiloxyethyl dimethicone (manufactured by Shin-Etsu Chemical Co., Ltd.)

KF-9909: triethoxysilylethyl polydimethylsiloxyethyl hexyldimethicone (manufactured by Shin-Etsu Chemical Co., Ltd.)

KF-99: Linear methyl hydrogen silicone oil (manufactured by Shin-Etsu Chemical Co., Ltd.)

KP-574: Surface modifier having an acrylic main chain with a silicone side chain (acrylates/tridecyl acrylate/triethoxysilylpropyl methacrylate/dimethicone methacrylate copolymer) (manufactured by Shin-Etsu Chemical Co., Ltd.)

KP-578: Graft copolymer consisting of acrylic polymer and dimethylpolysiloxane, prepared by modifying an acrylic polymer with silicone chain (manufactured by Shin-Etsu Chemical Co., Ltd.)

Novec 2702: Fluorine-based surface modifier including fluorinated methacrylate polymer (manufactured by 3M Company)

KBM-503: Silane coupling agent, 3-methacryloxypropyltrimethoxysilane (manufactured by Shin-Etsu Chemical Co., Ltd.)

<<Preparation of Photoreceptor>>

[Preparation of Photoreceptor 1]

(1) Preparation of Conductive Support

A conductive support was prepared by cutting the surface of a cylindrical aluminum support.

(2) Formation of Intermediate Layer

The following materials were mixed and dispersed for 10 hours in a batch mode using a sand mill as a disperser to prepare a coating liquid for forming the intermediate layer. The prepared coating liquid for forming the intermediate layer was applied to a surface of the above conductive support through dip coating. After drying at 110° C. for 20 minutes, to obtain an intermediate layer having a thickness of 2 μm on the conductive support.

| | |
|---|---|
| Polyamide resin "X 1010" (manufactured by Daicel-Evonik Ltd.): | 10 parts by mass |
| Titanium oxide "SMT500SAS" (Number average primary particle diameter: 0.035 μm, manufactured by TEIKA Co. Ltd.): | 11 parts by mass |
| Ethanol | 200 parts by mass |

(3) Formation of Charge Generating Layer

A coating liquid for forming the charge generating layer was prepared through mixing of the following materials with a circulating ultrasonic homogenizer "RUS-600 TCVP" (manufactured by Nihonseiki Kaisha Ltd). The dispersion was done under the conditions of 19.5 kHz, 600 W, circulating flow rate of 40 L/hour for 0.5 hours.

The above-described coating liquid for forming the charge generating layer was applied onto the surface of the intermediate layer through dip coating, and dried to form a charge generating layer having a thickness of 0.3 m. The charge generating substance described below was a mixed crystal made of 1:1 adduct of titanylphthalocyanine (having diffraction peaks at 8.3°, 24.7°, 25.1°, and 26.5° as measured by Cu-Kα X-ray diffractometry) and (2R,3R)-2,3-butandiol and non-adduct of titanylphthalocyanine.

| | |
|---|---|
| Charge generating substance: | 24 parts by mass |
| Poly(vinyl butyral) resin "S-LEC ® BL-1" (manufacturedby Sekisui Chemical Co. Ltd.): | 12 parts by mass |
| Mixed solvent (volume ratio of 3-methyl-2-butanone to cyclohexanone was 4:1): | 400 parts by mass |

(4) Formation of Charge Transporting Layer

A coating liquid for forming the charge transporting layer was prepared through mixing of the following materials and applied onto the surface of the charge generating layer through dip coating, and dried at 120° C. for 70 minutes to form a charge transporting layer having a thickness of 24 μm.

| | |
|---|---|
| Charge transporting substance 1 (detailed below): | 60 parts by mass |
| Polycarbonate resin "Iupilon Z300" (Bisphenol-z polycarbonate manufactured by Mitsubishi Gas Chemical Co. Inc.): | 100 parts by mass |
| Antioxidant "Irganox 1010" (manufactured by BASF Japan Co. Ltd.): | 4 parts by mass |

Charge Transporting Material 1

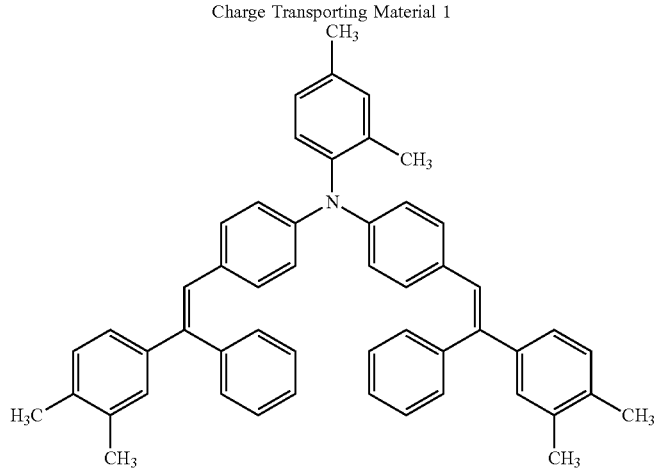

(5) Formation of Outermost Layer

A coating liquid for forming the outermost layer was prepared through mixing of the following materials and applied onto the surface of the charge transporting layer using a circular slide hopper device. The coating of the outermost layer was irradiated with ultraviolet rays (main wavelength: 365 nm) using a metal halide lamp for 1 minute (illuminance of the ultraviolet rays was 16 mW/cm$^2$ and irradiation amount of the ultraviolet rays was 960 mJ/cm$^2$) to form a cured outermost layer having a thickness of 5.0 m on the charge transporting layer. Photoreceptor 1 was thereby prepared. Irgacure 819 (manufactured by BASF Japan Co. Ltd.) was used as the polymerization initiator.

| | |
|---|---|
| Polymerizable monomer: Exemplified compound M2: | 100 parts by mass |
| Surface-modified inorganic filler F-1 | 100 parts by mass |
| Phenol derivative: Exemplified compound P1 | 3 parts by mass |
| Polymerization initiator ("Irgacure 819" made by BASF Japan Co. Ltd.): | 10 parts by mass |
| 2-Butanol: | 400 parts by mass |

[Preparation of Photoreceptors 2 to 11 and 13 to 17]

Photoreceptors 2 to 11 and 13 to 17 were prepared in the same manner as the above-described photoreceptor 1 except that the surface-modified inorganic filler used in formation of the outermost layer and the phenol derivative were changed as described in TABLE II.

The following compounds A1 to A3 were used as phenol derivatives in preparation of the Photoreceptors 15 to 17 in Comparative Examples.

Compound A1

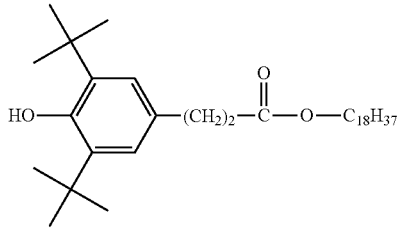

Compound A2

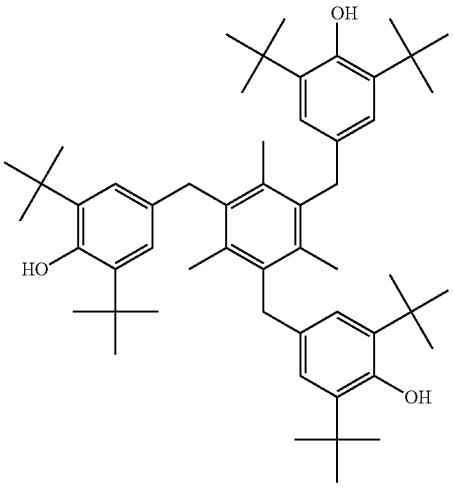

Compound A3

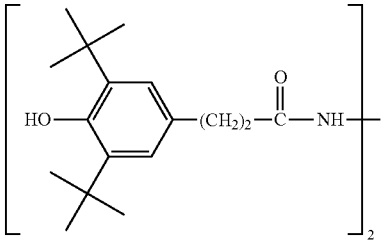

[Preparation of Photoreceptor 12]

Photoreceptor 12 was prepared in the same manner as the above-described photoreceptor 3 except that 3 parts by mass of the following compound 1 was added to the coating liquid for forming the outermost layer.

Compound 1

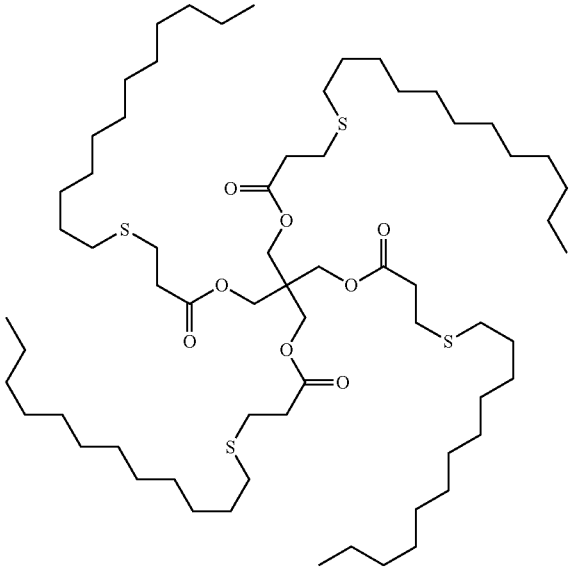

[Preparation of Photoreceptor 18]

Photoreceptor 18 was prepared in the same manner as the above-described photoreceptor 3 except that Surface-modified inorganic filler F-3 was not added to the coating liquid for forming the outermost layer.

[Preparation of Photoreceptor 19]

Photoreceptor 19 was prepared in the same manner as the above-described photoreceptor 1 except that the outermost layer was prepared as described below.

(Formation of Outermost Layer)

An oligomerized solution was prepared through mixing of the following materials and stirring at 50° C. for 24 hours.

<Oligomerized Solution>

| | |
|---|---|
| Methyltrimethoxysilane | 70 parts by mass |
| Dimethoxydimethylsilane | 25 parts by mass |
| 2-propanol | 50 parts by mass |
| Acetic acid of 3% | 10 parts by mass |

Next, a coating liquid for forming the outermost layer was prepared through mixing of the following materials, applied onto the surface of the charge transporting layer using a circular slide hopper device, and cured by heating at 120° C. for 1 hours to form an outermost layer having a thickness of 5.0 m.

<Coating Liquid for Forming Outermost Layer>

| | |
|---|---|
| Oligomerized Solution described above | 155 parts by mass |
| Tetramethoxysilane | 10 parts by mass |
| Vinyl resin having silyl group described below (solid content: 50 mass %) | 100 parts by mass |
| Phenol derivative: Exemplified compound P1 | 3 parts by mass |
| 2-propanol | 30 parts by mass |
| 2-butanone | 100 parts by mass |
| Aluminum chelate A (W) (manufactured by Kawaken Fine Chemicals Co., Ltd.) | 10 parts by mass |

<Synthesis of Vinyl Resin having Silyl Group>

Mixed monomers (65 parts by mass of methyl methacrylate, 35 parts by mass of n-butyl acrylate, 20 parts by mass of 3-methacryloxypropyltrimethoxysilane (Product name: KBM503, manufactured by Shin-Etsu Chemical Co., Ltd.), 10 parts by mass of N-methylol acrylamide, and 6 parts by mass of acrylic acid) were dissolved in 130 parts by mass of isopropyl alcohol, and stirred at 80° C. After dropwise addition of 4 parts by mass of azobisisobutyronitrile dissolved in 10 parts by mass of xylene and reaction for 4 hours, vinyl resin having silyl group (solid content: 50 mass %) was prepared.

[Preparation of Photoreceptor 20]

Photoreceptor 20 was prepared in the same manner as the above-described photoreceptor 13 except that Iupilon Z300 (manufactured by Mitsubishi Gas Chemical Co. Inc.) was used as the Polycarbonate resin instead of the Exemplified compound M2, tetrahydrofuran (THF) was used instead of the 2-butanol, and thermal drying (at 120° C. for 60 minutes) was done instead of ultraviolet irradiation.

TABLE II

| Photo- | Composition or Outermost Layer | | | | | |
|---|---|---|---|---|---|---|
| receptor | Polymerizable | Inorganic | Phenol Derivative | | Other | |
| No. | Monomer | Filler | Compound | L1(* 1) | Additive | Remarks |
| 1 | Exemplified Compound M2 | F- 1 | Exemplified Compound P1 | 19 | — | Present Invention |
| 2 | Exemplified Compound M2 | F- 2 | Exemplified Compound P1 | 19 | — | Present Invention |
| 3 | Exemplified Compound M2 | F- 3 | Exemplified Compound P1 | 19 | — | Present Invention |
| 4 | Exemplified Compound M2 | F- 3 | Exemplified Compound P2 | 11 | — | Present Invention |
| 5 | Exemplified Compound M2 | F- 4 | Exemplified Compound P1 | 19 | — | Present Invention |
| 6 | Exemplified Compound M2 | F- 5 | Exemplified Compound P1 | 19 | — | Present Invention |
| 7 | Exemplified Compound M2 | F- 6 | Exemplified Compound P1 | 19 | — | Present Invention |
| 8 | Exemplified Compound M2 | F- 7 | Exemplified Compound P1 | 19 | — | Present Invention |
| 9 | Exemplified Compound M2 | F- 8 | Exemplified Compound P1 | 19 | — | Present Invention |
| 10 | Exemplified Compound M2 | F- 3 | Exemplified Compound P3 | 14 | — | Present Invention |
| 11 | Exemplified Compound M2 | F- 3 | Exemplified Compound P4 | 13 | — | Present Invention |
| 12 | Exemplified Compound M2 | F- 3 | Exemplified Compound P1 | 19 | Compound 1 | Present Invention |
| 13 | Exemplified Compound M2 | F- 9 | Exemplified Compound P1 | 19 | — | Present Invention |
| 14 | Exemplified Compound M2 | F- 10 | Exemplified Compound P1 | 19 | — | Present Invention |
| 15 | Exemplified Compound M2 | F- 3 | Compound A1 | — | — | Comparative Example |
| 16 | Exemplified Compound M2 | F- 3 | Compound A2 | 5 | — | Comparative Example |
| 17 | Exemplified Compound M2 | F- 3 | Compound A3 | 8 | — | Comparative Example |
| 18 | Exemplified Compound M2 | — | Exemplified Compound P1 | 19 | — | Comparative Example |
| 19 | Exemplified Compound M2 | — | Exemplified Compound P4 | 13 | — | Comparative Example |
| 20 | Polycarbonate Resin | F- 9 | Exemplified Compound P1 | 19 | — | Comparative Example |

(* 1)Number of Atoms with Atomic Number of 12 or More

<<Evaluation of Photoreceptor>>

[Preparation of Image Forming Apparatus]

Each of the above photoreceptors was placed at the black (K) position of the image forming unit of a full-color printing machine (bizhub PRESS C1070, manufactured by Konica Minolta) modified to have a linear rate of 500 mm/sec to prepare an image forming apparatus for evaluation.

[Evaluation of Photoreceptor]

(Evaluation for Image Blurring Suppression)

In accordance with the following method, the images formed at the start of the printing (initial printing) and after the durability test were evaluated for image blurring reduction.

<Image Blurring Reduction at Initial Priming>

Image blurring reduction at initial printing was evaluated as follows. The main power of the image forming apparatus was immediately turned off immediately after a test image consisting of a solid vertical band of 10% coverage as shown in FIG. 4 was printed on 10,000 sheets of A4 size in landscape mode under an environment of 30° C. and 85% RH.

Printed matter for evaluation of image blurring reduction at initial printing was prepared as follows. 24 hours after the main power was turned off, the main power was turned on again. Immediately after the image forming apparatus was ready for printing, a halftone image (relative reflection density measured with a Macbeth densitometer was 0.4) was printed on the entire surface of an A3-size transfer material. A printed matter for evaluation of image blurring reduction at initial printing was thereby obtained.

<Image Blurring Reduction after Durability Test>

Figure 4:
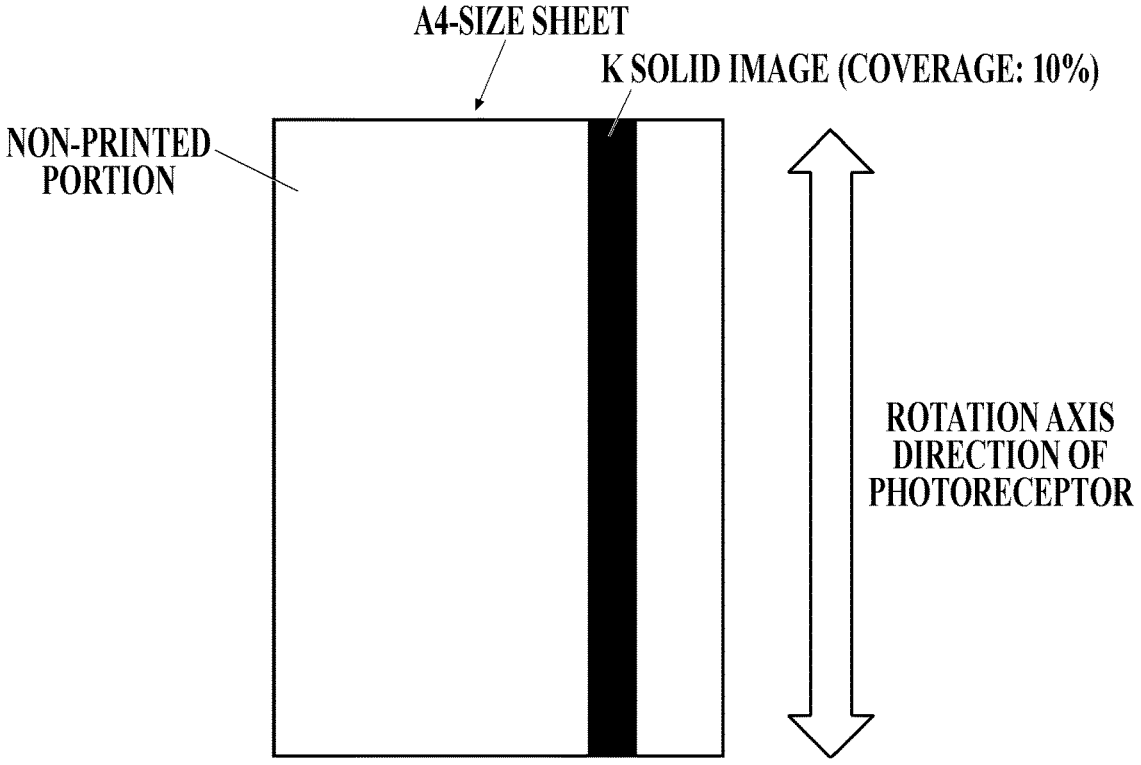
FIG. 4 is a schematic view for explaining an evaluating method of the photoreceptor in an example of the present invention.

In the durability test, a test image consisting of a solid vertical band of 10% coverage as shown in FIG. 4 was continuously printed on 100,000 sheets of A4 size in landscape mode under an environment of 30° C. and 85% RH.

Next, in the same manner as the evaluation at initial printing described above, the main power of the image forming apparatus was immediately turned off immediately after a test image consisting of a solid vertical band of 10% coverage as shown in FIG. 4 was printed on 10,000 sheets of A4 size in landscape mode under an environment of 30° C. and 85% RH.

Printed matter for evaluation of image blurring reduction after durability test was prepared as follows. 24 hours after the main power was turned off, the main power was turned on again. Immediately after the image forming apparatus was ready for printing, a halftone image (relative reflection density measured with a Macbeth densitometer was 0.4) was printed on the entire surface of an A3-size transfer material. A printed matter for evaluation of image blurring reduction after durability test was thereby obtained.

The image quality of the halftone image printed on the printed matter for evaluation prepared as described above was visually observed and evaluated according to the following criteria. When there was density unevenness, the density was measured with a Macbeth densitometer. Here, ranks A to C were accepted, and ranks D to E were rejected. The image quality was acceptable when the evaluation result was A, B, or C, and the image quality was unacceptable when evaluation result was D or E.

A: There is no image blurring in halftone images. (Good)

B: In the first halftone image, there is observed a band-shaped portion that has density difference of 0.1 or less from surrounding portions and that is along the major axis of the photoreceptor, but in the third and subsequent halftone images, there is observed no density difference. There is no problem in practical use.

C: In the first halftone image, there is observed a band-shaped portion that has density difference of 0.1 or less from surrounding portions and that is along the major axis of the photoreceptor, but in the 10th and subsequent halftone images, there is observed no density difference. There is no problem in practical use.

There is no problem in practical use.

D: In the first halftone image, there is observed a band-shaped portion that has density difference of 0.1 or less from surrounding portions and that is along the major axis of the photoreceptor, and in the 10th and subsequent halftone images, there is also observed the density difference. There is a problem in practical use.

E: In the first halftone image, there is observed a band-shaped portion that has density difference of more than 0.1 from surrounding portions and that is along the major axis of the photoreceptor, and in the 10th and subsequent halftone images, there is also observed the density difference. There is a problem in practical use.

(Evaluation for Scratch Resistance)

<Durability Test>

In the durability test, a test image consisting of a solid vertical band of 10% coverage as shown in FIG. 4 was continuously printed on 100,000 sheets of A4 size in landscape mode under an environment of 30° C. and 85% RH.

Next, under an environment of 30° C. and 85% RH, surface conditions of the photoreceptor were visually observed, and a halftone image (relative reflection density measured with a Macbeth densitometer was 0.4) was printed on the entire surface of an A3-size transfer material using the photoreceptor after the durability test. The images after the durability test were checked for defects and ranked according to the following criteria. The image quality was acceptable when the evaluation result was A, B, or C, and the image quality was unacceptable when evaluation result was D.

A: There is no visible scratch on the surface of the photoreceptor, and there is also observed no image defect corresponding to the scratch of the photoreceptor in the output halftone image. (Good quality)

B: There are one to three visible minor scratches on the surface of the photoreceptor, but there is observed no image defect corresponding to the scratches of the photoreceptor in the output halftone image. There is no problem in practical use.

C: There are four to six visible minor scratches on the surface of the photoreceptor, but there is observed no image defect corresponding to the scratches of the photoreceptor in the output halftone image. There is no problem in practical use.

D: There are obviously visible scratches on the surface of the photoreceptor, and there is also observed image defects corresponding to the scratches of the photoreceptor in the output halftone image. There is a problem in practical use.

The results obtained above are shown in Table III.

TABLE III

| Photo-receptor No. | Image Blur Suppression: At Initial Printing Test | Image Blur Suppression: After Durability Test | Scratch Resistance | Remarks |
|---|---|---|---|---|
| 1 | A | A | B | Present Invention |
| 2 | A | A | B | Present Invention |
| 3 | A | A | A | Present Invention |
| 4 | A | B | B | Present Invention |
| 5 | A | A | C | Present Invention |
| 6 | A | A | A | Present Invention |
| 7 | A | A | A | Present Invention |
| 8 | A | A | A | Present Invention |
| 9 | B | B | C | Present Invention |
| 10 | A | B | A | Present Invention |
| 11 | A | B | A | Present Invention |
| 12 | A | A | A | Present Invention |
| 13 | A | B | C | Present invention |
| 14 | C | C | C | Present Invention |
| 15 | D | E | C | Comparative Example |
| 16 | C | C | D | Comparative Example |
| 17 | B | C | D | Comparative Example |
| 18 | A | A | D | Comparative Example |
| 19 | A | B | D | Comparative Example |
| 20 | A | A | D | Comparative Example |

As is clear from the results in Table III that, according to the electrophotographic photoreceptor of the present invention, image blurring can be more reduced and scratch resistance is better than the electrophotographic photoreceptor of the comparative example even after long-term image output.

Although embodiments of the present invention have been described and illustrated in detail, the disclosed embodiments are made for purposes of illustration and example only and not limitation. The scope of the present invention should be interpreted by terms of the appended claims.

What is claimed is:

1. An electrophotographic photoreceptor comprising a cured outermost layer that includes a polymerized cured product including at least an inorganic filler and a phenol derivative, the inorganic filler being surface-modified with a surface modifier, and the phenol derivative having a structure represented by Formula (1), Formula (1)

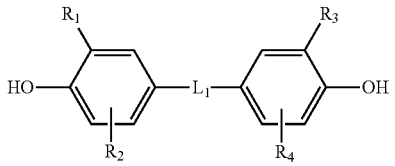

in Formula (1), $R_1$ and $R_3$ each independently represent an alkyl group having three or more carbon atoms, $R_2$ and $R_4$ each independently represent a hydrogen atom or an alkyl group having 1 to 10 carbon atoms, and $L_1$ represents a linking group having at least 10 atoms with an atomic number of 12 or more.

2. The electrophotographic photoreceptor according to claim 1, wherein the surface modifier includes a silicone chain.

3. The electrophotographic photoreceptor according to claim 1, wherein the surface modifier has a side chain including a silicone chain.

4. The electrophotographic photoreceptor according to claim 3, wherein the surface modifier has an acrylic main chain that branches into the side chain including a silicone chain.

5. The electrophotographic photoreceptor according to claim 3, wherein the surface modifier has a silicone main chain that branches into the side chain including a silicone chain.

6. The electrophotographic photoreceptor according to claim 1, wherein $R_1$ and $R_3$ in the Formula (1) each independently represent an alkyl group having four or more and eight or less carbon atoms.

7. The electrophotographic photoreceptor according to claim 1, wherein the inorganic filler has a polymerizable group.

8. The electrophotographic photoreceptor according to claim 1, wherein the phenol derivative having a structure represented by the Formula (1) has two phenol rings in one molecule.

9. The electrophotographic photoreceptor according to claim 1, wherein the linking group $L_1$ in the phenol derivative having a structure represented by the Formula (1) has a cyclic acetal structure.

10. The electrophotographic photoreceptor according to claim 1, wherein the inorganic filler is a composite fine particle having a conductive metal oxide attached to a surface of a core made of an insulating material.

11. The electrophotographic photoreceptor according to claim 1, wherein the inorganic filler and the phenol derivative are separately dispersed in the polymerized cured product.

* * * * *